US008026855B2

(12) United States Patent
Sakuma et al.

(10) Patent No.: US 8,026,855 B2
(45) Date of Patent: Sep. 27, 2011

(54) RADIO APPARATUS AND ANTENNA THEREOF

(75) Inventors: Masao Sakuma, Yokohama (JP); Norikazu Ebisawa, Yokohama (JP)

(73) Assignee: Fujitsu Semiconductor Limited, Yokohama (JP)

( * ) Notice: Subject to any disclaimer, the term of this patent is extended or adjusted under 35 U.S.C. 154(b) by 383 days.

(21) Appl. No.: 12/198,271

(22) Filed: Aug. 26, 2008

(65) Prior Publication Data

US 2009/0058738 A1 Mar. 5, 2009

(30) Foreign Application Priority Data

Aug. 31, 2007 (JP) ..... 2007-226327

(51) Int. Cl.
*H01Q 1/24* (2006.01)

(52) U.S. Cl. ..... 343/702

(58) Field of Classification Search ..... 333/133–134; 343/702, 700 MS, 741–742
See application file for complete search history.

(56) References Cited

U.S. PATENT DOCUMENTS

| | | | | |
|---|---|---|---|---|
| 3,865,873 | A | 2/1975 | Oda et al. | |
| 5,717,231 | A * | 2/1998 | Tserng et al. | 257/276 |
| 6,351,195 | B1 | 2/2002 | Atokawa et al. | |
| 6,646,605 | B2 * | 11/2003 | McKinzie, III et al. | 343/700 MS |
| 7,471,248 | B2 * | 12/2008 | Popugaev et al. | 343/700 MS |
| 7,479,846 | B2 * | 1/2009 | Inoue et al. | 333/133 |
| 2002/0105479 | A1 | 8/2002 | Hamada et al. | |
| 2003/0071763 | A1 * | 4/2003 | McKinzie, III et al. | 343/909 |
| 2003/0210189 | A1 | 11/2003 | Jinushi | |
| 2005/0017902 | A1 | 1/2005 | Oyama et al. | |
| 2005/0078038 | A1 | 4/2005 | Takaki et al. | |
| 2007/0146217 | A1 | 6/2007 | Stricker | |
| 2007/0296635 | A1 * | 12/2007 | Popugaev et al. | 343/700 MS |

FOREIGN PATENT DOCUMENTS

| | | | |
|---|---|---|---|
| EP | 1801914 | A1 | 6/2007 |
| EP | 1 950 833 | A1 | 7/2008 |
| JP | 48-91009 | | 11/1973 |
| JP | 7-58429 | | 3/1995 |
| JP | 8-204433 | | 8/1996 |
| JP | 10-272732 | | 10/1998 |
| JP | 2001-313516 | | 11/2001 |
| JP | 3319418 | | 9/2002 |
| JP | 2002-290132 | | 10/2002 |
| JP | 2003-037422 | | 2/2003 |
| JP | 2003-158410 | | 5/2003 |
| JP | 2003-332825 | | 11/2003 |
| JP | 2004-363848 | | 12/2004 |
| JP | 2005-94742 | | 4/2005 |
| JP | 2006-311152 | | 11/2006 |
| JP | 2007-20133 | | 1/2007 |
| JP | 2007-123982 | | 5/2007 |

OTHER PUBLICATIONS

Office Action mailed from the Japanese Patent Office on Jul. 26, 2011 in the corresponding Japanese patent application No. 2007-226327.

* cited by examiner

*Primary Examiner* — Huedung Mancuso
(74) *Attorney, Agent, or Firm* — Staas & Halsey LLP

(57) ABSTRACT

A feed element and a parasitic element are formed on the ends of a board. The feed element is formed on the surface of the board, and the parasitic element is formed on the back of the board. A circuit region of the board is mounted with a radio communication circuit. The feed element is connected with a signal line, and the parasitic element is connected with a GND line. A slit is provided between the feed element and the circuit region, and a slit is provided between the parasitic element and the circuit element.

9 Claims, 15 Drawing Sheets

RADIO APPARATUS AND ANTENNA THEREOF

CROSS REFERENCE TO RELATED APPLICATIONS

This application is based upon and claims the benefit of priority from the prior Japanese Patent Application No. 2007-226327, filed on Aug. 31, 2007, the entire contents of which are incorporated herein by reference.

BACKGROUND

1. Field

The embodiment relates to a radio apparatus and a configuration of an antenna in the radio apparatus.

2. Description of the Related Art

Along with the popularization of radio communications in recent year, various radio communication apparatuses (such as cellular phones, cordless telephones, wireless communication PC cards, small radio devices, and mobile radio apparatuses) have been in wide use. Among those apparatuses, small radio devices particularly are desired to have an antenna installed in their cases. For that reason, in order to realize reduction in size, weight and thickness, a configuration in which antennas are formed utilizing circuit boards.

Patent Document 1 (Japanese Patent Application Publication No. 08-204433) that is one of the known arts describes a configuration in which antennas are formed on a dielectric substrate. A pair of a microstrip line and a GND line are formed on the front surface and back surface of the dielectric substrate. On the front surface of the dielectric substrate, an antenna element is formed at the end of the microstrip line, and on the back surface of the dielectric substrate, another antenna element is formed at the end of the GND line. These antenna elements constitute a dipole antenna. Note that the configuration in which an antenna is formed utilizing a circuit board requires only a few number of components and a few mounting processes, and therefore the implementation time can be reduced.

The conventional antenna did not have a sufficient resonant frequency bandwidth. In particular, for the WiMAX that is expected to be widely popularized in the future radio communications, an antenna with a wide resonant frequency band has not been developed. Here, the resonant frequency band is not specified, but is for example defined by a range of a frequency band in which VSWR (Voltage Standing Wave Ratio) is smaller than 2.

When the resonant frequency band of an antenna is narrow, the antenna characteristics could be degraded only by a small external factor. For example, when a metal conductor is present near the antenna (e.g. placing a radio apparatus on a metal table), the resonant frequency band of the antenna may be changed. In such a case, the frequency of a desired wave becomes out of the resonant frequency band, with the result that the desired wave cannot be received. In order to reduce the size of the radio apparatus, an antenna has to be arranged near a high-frequency circuit. In such a case, the antenna characteristics are subjected to the influence of noise from the high-frequency circuit. For that reason, preventions such as a shield cover are implemented. At that time, if the resonant frequency band of the antenna is narrow, the required antenna characteristics sometimes cannot be obtained and transmission characteristics/reception characteristics are easily degraded. In order to secure desirable transmission characteristic/reception characteristics, large current is required to amplify signals, which would cause a problem in reducing power consumption of the radio apparatus.

SUMMARY

One aspect of a radio apparatus is used for radio communication, and comprises an antenna, a circuit connected to the antenna, and a board on which the antenna and the circuit are mounted and in which the board is not present but a material having lower permittivity than the board is present in at least a portion between the antenna and the circuit.

DESCRIPTION OF THE EMBODIMENTS

Embodiments of a radio apparatus and a configuration of an antenna in the radio apparatus are explained. In the following description, a dipole antenna having a feed element and a parasitic element is explained as an embodiment. The dipole antenna is provided on the board that has circuits for radio communications.

First, a design concept of the antenna of the embodiment is explained.

Figure 1:
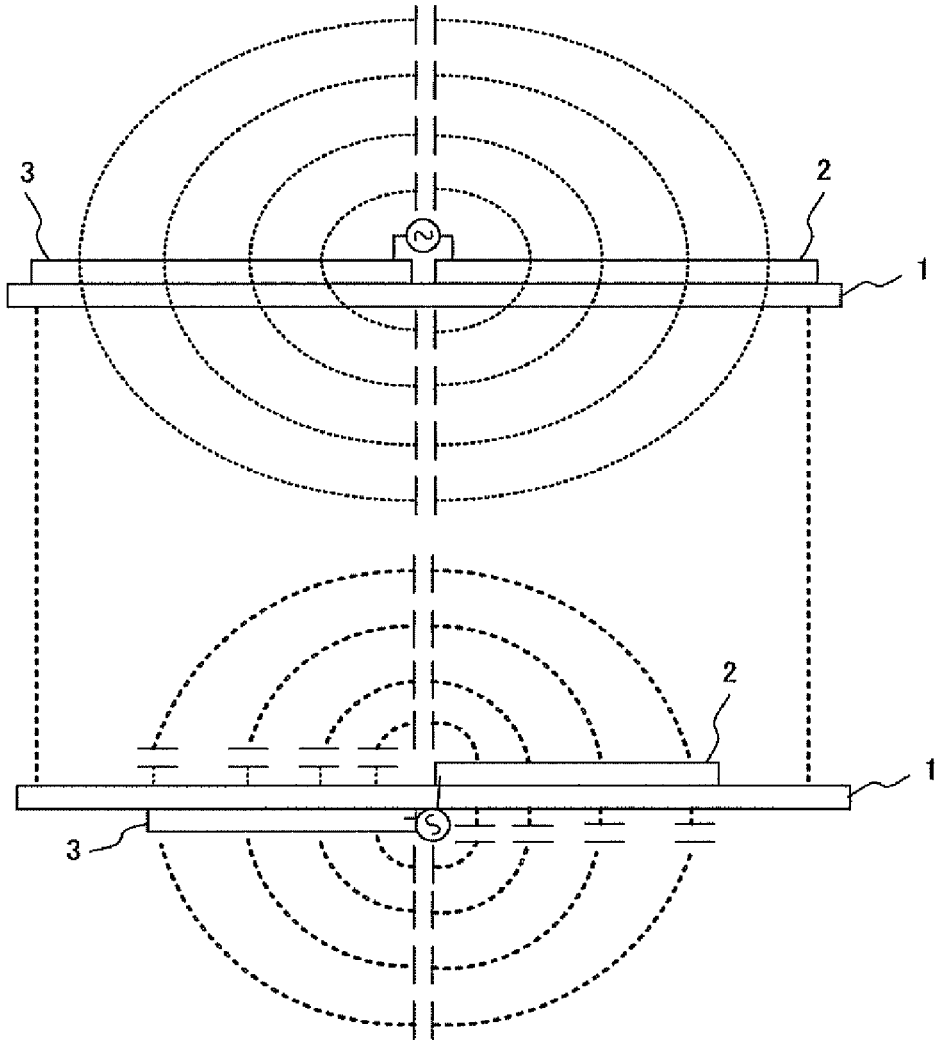
FIG. 1, FIG. 2A, and FIG. 2B are diagrams for explaining arrangements of antenna elements.

(1) As shown in FIG. 1, a feed element 2 and a parasitic element 3 constituting an antenna element can be formed on the same surface layer of a board 1. It is also possible to form the feed element 2 on one surface layer of the board 1 and the parasitic element 3 on another surface layer of the board 1. If, however, the board 1 is made with a dielectric material, the length of each antenna element required to obtain a certain resonant frequency can be shorter in the configuration in which the feed element 2 and the parasitic element 3 are formed on different surface layers than in the configuration in which the feed element 2 and the parasitic element 3 are formed on the same surface layer. For that reason, in order to reduce the size of the antenna, it is preferable to form the feed element 2 and the parasitic element 3 on different surface layers of the board 1.

Figure 2A:
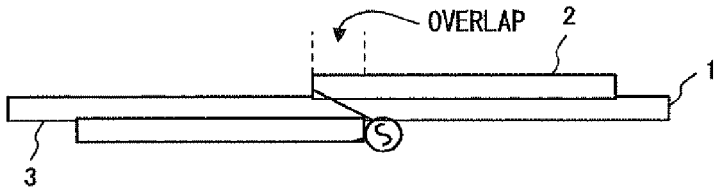
Figure 2B:
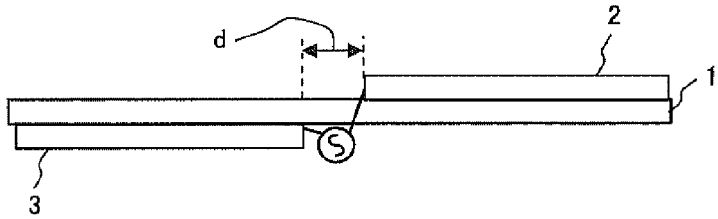

(2) In the configuration in which the feed element 2 and the parasitic element 3 are formed on different surface layers of the board 1, it is possible to place the feed element 2 and the parasitic element 3 so as to overlap with one another as shown in FIG. 2A. In such a configuration, the size of the antenna can be reduced; however, the resonant frequency band of the antenna is also reduced. Meanwhile, by providing a space d between the feed element 2 and the parasitic element 3 as shown in FIG. 2B, the resonant frequency band of the antenna increases in width. For example, in a case that the relative permittivity $\in r$ of the board 1 is approximately 4.8, sufficiently wide resonant frequency band can be secured by having the space d being larger than $\lambda/230$. Note that "$\lambda$" is a wavelength of a carrier wave transmitted/received via the antenna. For example, the space is designed to be approximately "$d \geqq 0.5$ mm" in a frequency band of 2.5-2.7 GHz. Accordingly, in order to achieve a wide resonant frequency band of the antenna, it is preferable to have a certain space d between the feed element 2 and the parasitic element 3.

Figure 3:
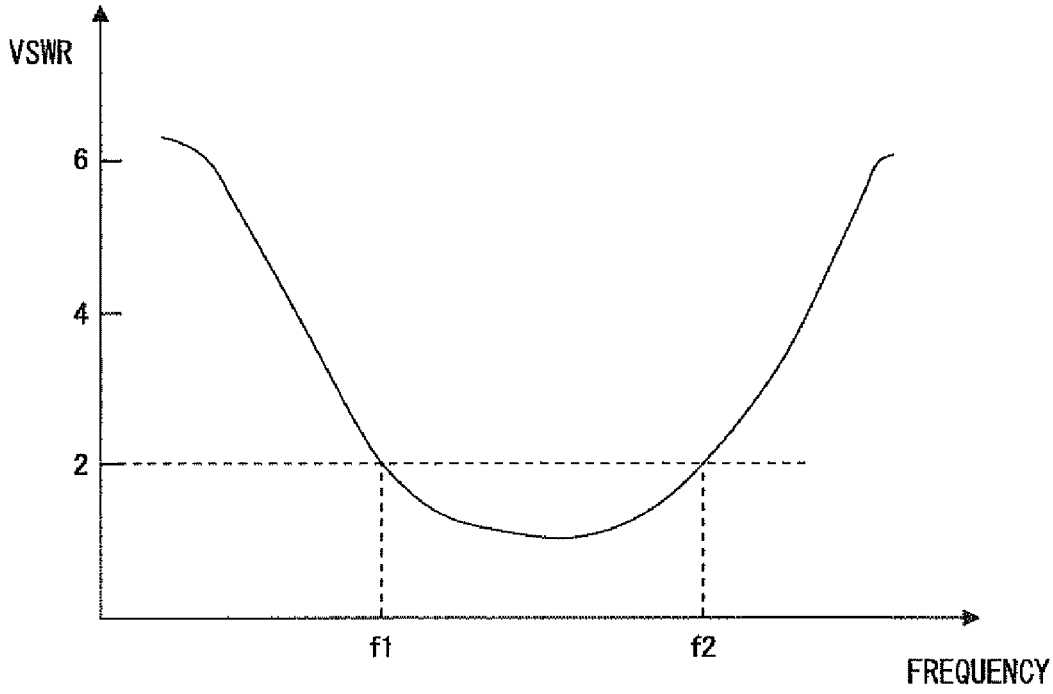
FIG. 3 is a diagram for explaining the resonant frequency band.

In this specification, the resonant frequency band of an antenna is defined by VSWR (Voltage Standing Wave Ratio). In other words, the resonant frequency band is defined as for example "a frequency band in which VSWR is smaller than 2" as shown in FIG. 3. Alternatively, bandwidth characteristic is defined by an equation (1) provided below as an index of the resonant frequency band.

$$\text{Bandwidth characteristics } (\%) = 100 \times (f2 - f1)/(f1 + (f2 - f1)/2) \quad (1)$$

Figure 4A:
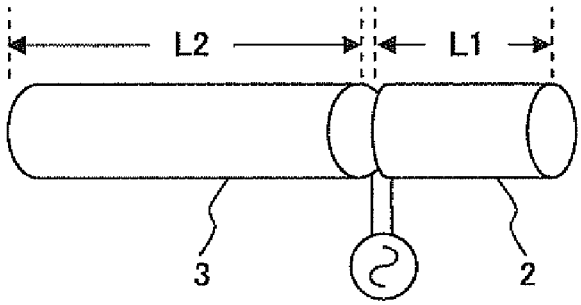
FIG. 4A and FIG. 4B are diagrams for explaining a configuration and an arrangement of the antenna elements.

(3) In FIG. 4A, a length L1 of the feed element 2 and a length L2 of the parasitic element 3 can be the same or can be different from one another. The resonant frequency of the antenna, however, depends on the lengths L1 and L2 of each antenna element (the feed element 2 and the parasitic element 3). Specifically, when the lengths L1 and L2 are different, resonance points obtained by each of the antenna elements are different, and therefore the resonant frequency band of the entire antenna becomes wide. Accordingly, in order to achieve a wide resonant frequency band, it is preferable that the length L1 of the feed element 2 and the length L2 of the parasitic element 3 are different. In such a case, the length L1 of the feed element 2 can be longer than the length L2 of the parasitic element 3 or the length L1 of the feed element 2 can be shorter than the length L2 of the parasitic element 3.

Figure 4B:
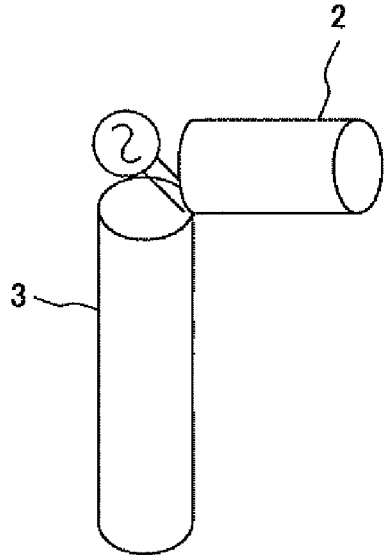

(4) The feed element 2 and the parasitic element 3 can be arranged linearly as shown in FIG. 4A or can be arranged at a certain angle (right angle in this example) with each other as shown in FIG. 4B. In general, when the feed element 2 and the parasitic element 3 are arranged at a certain angle with each other, the resonant frequency band is wider than a case when the feed element 2 and the parasitic elements are arranged linearly.

Figure 5:
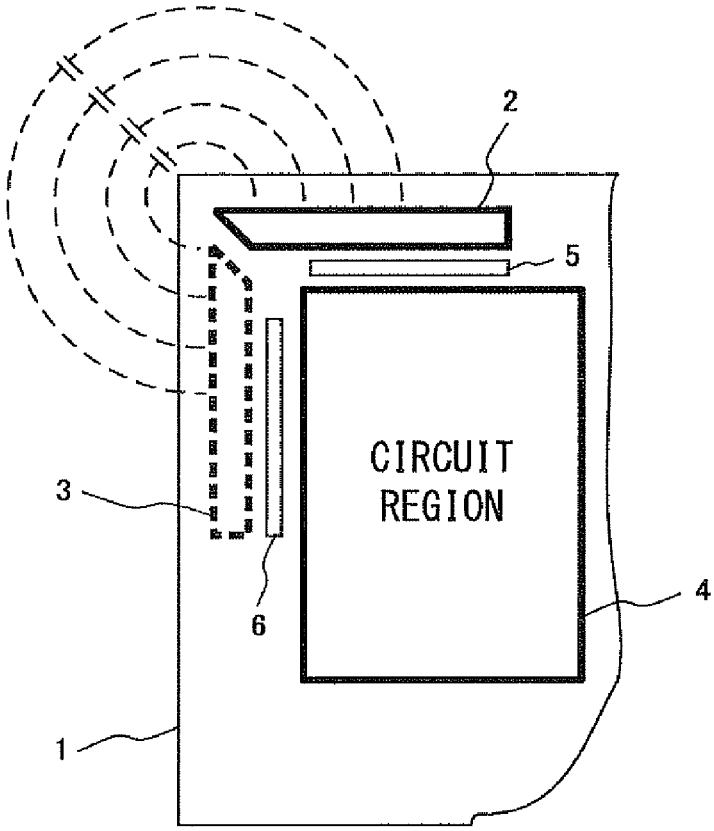
FIG. 5 is a diagram showing a configuration in which slits are provided between the antenna elements and a circuit region.

(5) As shown in FIG. 5, between each of the antenna elements (the feed element 2 and the parasitic element 3) and a circuit region 4, corresponding slits (spaces) 5 and 6 are provided. The circuit region 4 is a region on which circuits (e.g. an RF circuit for transmitting and/or receiving a signal in an RF band) for radio communications are mounted and includes a circuit GND. By having the slits 5 and 6, there are regions with lower permittivity than that of the board 1 formed between each of the antenna elements 2 and 3 and the circuit region 4. As a result, the capacities between each of the antenna elements 2 and 3 and the circuit region 4 become large, and electric/magnetic interactions between each of the antenna elements 2 and 3 and the circuit region 4 (particularly, influence of the circuit region 4 on each of the antenna elements 2 and 3) become small. In addition, because a coupling between the GND that is present around the radio apparatus and a high-frequency circuit becomes weak, the antenna elements 2 and 3 become less subjected to the influence of high-frequency noise. Because the capacity generated between the antenna elements 2 and 3 is coupled with the antenna, lengths of each antenna element 2 or 3 required to obtain a certain resonant frequency becomes short.

The shape (mainly a slit width) of the slits 5 and 6 required to obtain desired antenna characteristics (e.g. the resonant frequency band) depends on the permittivity of the board 1, the permittivity of the region having the slits 5 and 6 and the wavelength of the signal used in the radio communication. Here, the permittivity of the board 1 is determined by the material forming the board 1. The region having the slits 5 and 6 is filled with "air", and consequently, the relative permittivity $\in r$ of the region is approximately 1.0. When slits are filled with a low-permittivity material ($\in r > 1.0$), the band becomes narrower than a case where the slits are filled with the air. Accordingly, if the wavelength of the radio signal transmitted/received via the antenna is determined, the width of the slits 5 and 6 to obtain the required antenna characteristics can be calculated. The width of the slits 5 and 6, alternatively, can be determined by simulations or experiments so that desired characteristics can be obtained.

The relative permittivity $\in r$ of the region in which the slits 5 and 6 are formed is approximately 1.0. Meanwhile, if the board 1 is formed by a glass epoxy material as an example, the relative permittivity $\in r$ is approximately 4-5. In other words, "to have the slits 5 and 6" is one of the forms of "to have a region with a permittivity lower than that of the board 1". For that reason, the region having the slits 5 and 6 may be filled with a material with a permittivity lower than that of the board 1.

It should be noted that in the example shown in FIG. 5, the slit 5 is formed between the feed element 2 and the circuit region 4 and the slit 6 is formed between the parasitic element 3 and the circuit region 4. However, both of the slits 5 and 6 are not necessarily formed. In other words, a certain advantageous effect can be obtained by forming either one of the slit 5 or 6.

Figure 6A:
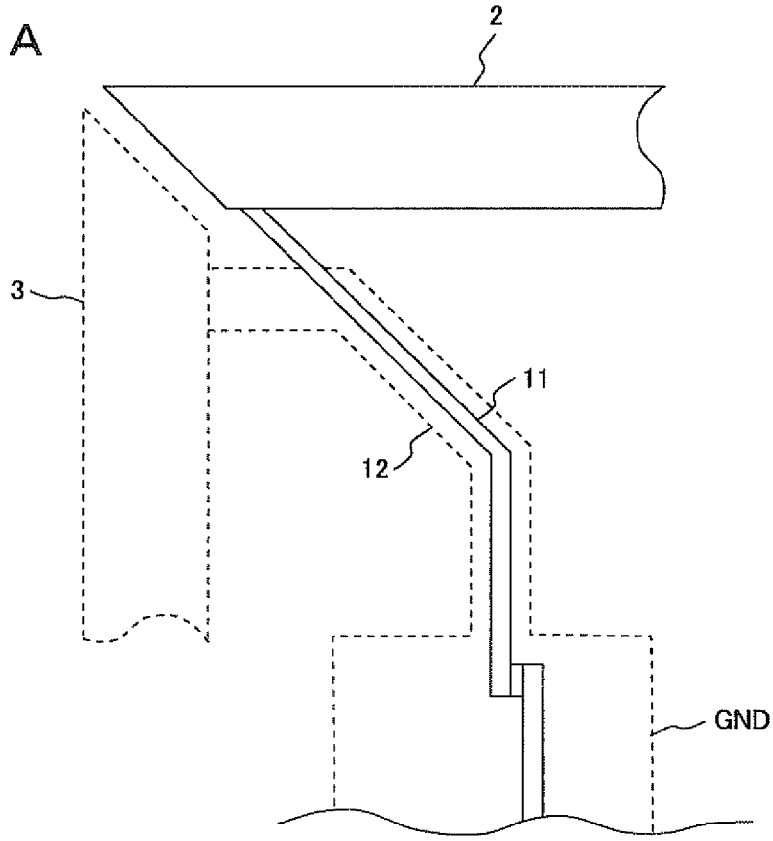
FIG. 6A and FIG. 6B are diagrams for explaining a signal line and a GND line.
Figure 6B:
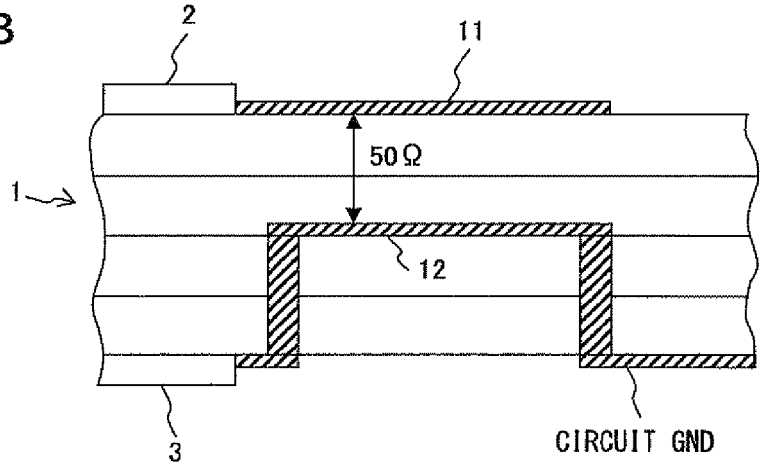

(6) As shown in FIG. 6A and FIG. 6B, a signal line 11 of the radio communication circuit is connected to the feed element 2. The parasitic element 3 is connected to a GND (i.e. a circuit GND) of the radio communication circuit via a GND line 12. The signal line 11 and the GND line 12 are, as shown in FIG. 6A, formed so as to extend in parallel. The width of the GND line 12 is more than three times as wide as the width of the signal line 11. The signal lien 11 and the GND line 12 are formed in different layers so that certain impedance (e.g. 50 ohms) can be obtained between the lines. In the example shown in FIG. 6B, the signal line 11 is formed on the surface layer of the board 1, and the GND line 12 is formed on an inner layer of the board 1. When the circuit GND and the GND line 12 are formed in different layers, the connection between the layers is, for example, realized by a through-hole. By introducing the configuration shown in FIG. 6A and FIG. 6B, leak of the signal (or an electromagnetic wave) from the signal line 11 is suppressed, and its reflection can be also suppressed.

Figure 7:
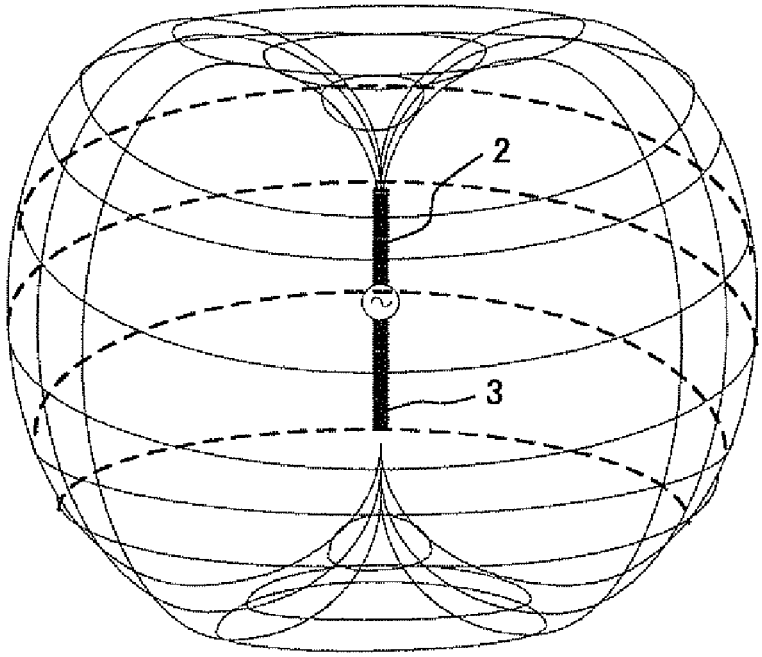
FIG. 7 is a diagram for explaining directivity of a dipole antenna.

FIG. 7 is a diagram explaining the directivity characteristics of the antenna. In the dipole antenna of the present embodiment, arranged so as to be orthogonal to one another, a pair of antenna elements basically has non-directivity characteristics. Note that the radiation from the end of each of the antenna elements (the feed element 2 and the parasitic element 3) is very weak. In other words, a null point is present in a longitudinal direction of each antenna element. Because the slits 5 and 6 are provided in a direction toward the circuit region 4 from each of the antenna elements, propagation of the signal is suppressed. Consequently, the signal that resonates with the antenna element is efficiently radiated to outer space, and the signal from the outer space can be efficiently received.

Figure 8:
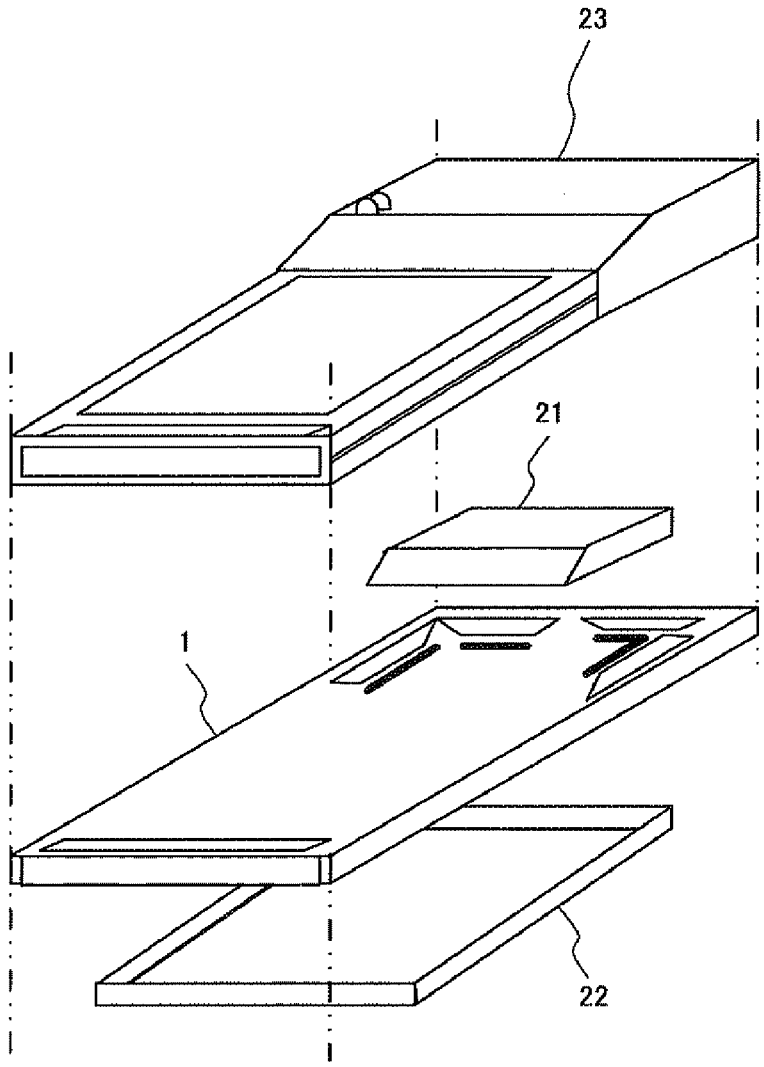
FIG. 8 is a diagram showing the configuration of a radio apparatus of the present embodiment.

FIG. 8 is a diagram showing a configuration of the radio apparatus of the present embodiment. The radio apparatus is not limited in particular; however, it is a radio communication apparatus installed in a personal computers etc. in this example Although the radio communication method is not limited in particular, it can be WiMAX or wireless LAN for example.

The board 1 is mounted with a radio communication circuit and an antenna. The radio communication circuit is formed on the circuit region 4 shown in FIG. 5. Antenna elements constituting the antenna are formed at the end of the board 1. Assume that the antenna is configured on the basis of at least one of the above design concepts (1)-(6). A shield cover 21 is formed by a metal plate etc., and shields electromagnetic waves radiated from the radio communication circuit. Note that the antenna elements are arranged outside of the shield cover 21. In other words, the shield cover 21 shields electromagnetic effects between the radio communication circuit and the antenna elements. A metal cover 22 is attached on the back surface of the board 1. A case 23 packs the board 1 to which the shield cover 21 and the metal cover 22 are attached.

Figure 9:
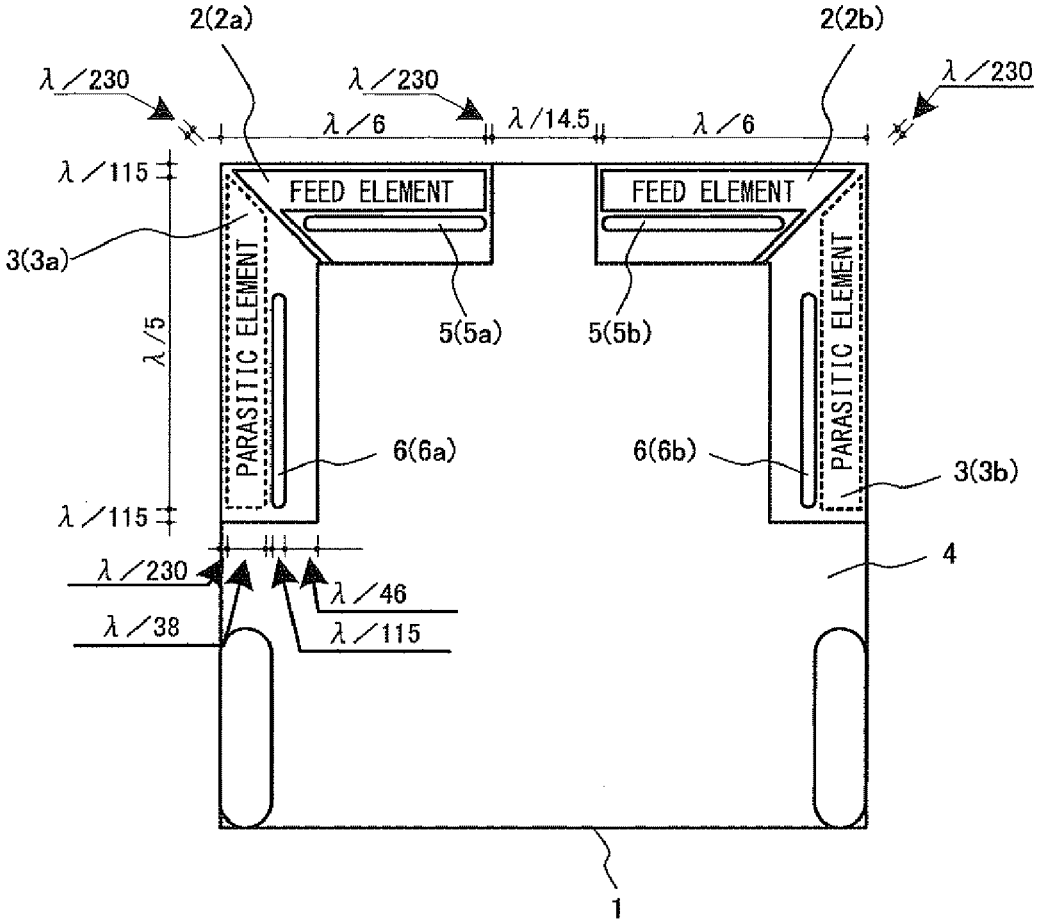
FIG. 9 is a diagram showing an antenna configuration of the radio apparatus of the present embodiment.

FIG. 9 is a diagram showing a configuration of an antenna of the radio apparatus of the present embodiment. In this example, two dipole antennas are provided on the board 1. The first antenna comprises a feed element 2*a* and a parasitic element 3*a*, and the second antenna comprises a feed element 2*b* and a parasitic element 3*b*. The feed elements 2*a* and 2*b* are formed on the surface layer of the board 1, and the parasitic elements 3*a* and 3*b* are formed on the back surface layer of the board 1. There are slits 5*a* and 5*b* formed between the feed elements 2*a* and 2*b*, respectively, and the circuit region 4, and there are slits 6*a* and 6*b*' formed between the parasitic elements 6*a* and 6*b*, respectively, and the circuit region 4.

The first and second antennas can transmit/receive different signals (or independent signals). Alternatively, the first and second antennas can transmit/receive the same signal. In such a case, the first and second antennas constitute a space diversity antenna.

The board 1 is a multilayer board made from a dielectric material. The dielectric material in this example is FR-4. FR-4 is a composite material of glass fiber and epoxy resin. The relative permittivity ∈r of FR-4 is 4.7-4.8 at 1 kHz, and is 4.2-4.3 at 1 MHz. The dielectric material to form the board 1 is not limited to FR-4, but other material can be also used. In other words, in addition to FR-4, aluminum, alumina, ceramic, Teflon, glass epoxy material (CEM-3, BT range), PPE, and FPC for example can be used as a material of the board 1.

In this example, the regions to which the slits 5 (5*a* and 5*b*) and the slits 6 (6*a* and 6*b*) are provided are air gaps. Therefore, the relative permittivity ∈r of the regions is 1.0.

The feed elements 2 (2*a* and 2*b*) and the parasitic elements 3 (3*a* and 3*b*) are formed from conductive foil in this example. The conductive foil is not limited in particular; however, it is for example aluminum foil. In the configuration in which the feed elements 2 and the parasitic elements 3 are formed from the cupper foil or aluminum foil, it is possible to form the elements 2 and 3 into a desirable shape in significantly high accuracy. In other words, it is possible to accurately form an antenna element designed by using CAD. As a result, a desirable antenna characteristic can be achieved. In addition, the size (in particular thickness) of the radio communication apparatus can be reduced. Note that a band of an antenna can be broader as the width of the antenna element becomes wider. In other words, a bandwidth that is approximately proportional to the antenna element width can be obtained.

Each of the antenna elements 2 and 3 are fixed at its end, for example, on the board 1. Here, the radiation from the end of each antenna elements is significantly weak, and therefore a null point is generated. In this case, each antenna element is fixed on the board 1 at the position of the null point. Note that each of the antenna elements 2 and 3 can be attached on the surface of the board 1.

The size of the antenna of the present embodiment is provided below. Note that in this example, the relative permittivity ∈r of the board 1 is 4.8, and the relative permittivity ∈r of the slit regions is 1.0. In the following, the size is represented by the wavelength λ of the carrier wave of the radio signal. Here, the radio frequency is 2.5-2.7 GHz. In other words, the wavelength λ is approximately 120 mm.

Length of the feed element 2: λ/6 (19.5 mm)

Length of the parasitic element 3: λ/5 (23 mm)

Width of the antenna elements 2 and 3: λ/38 (3 mm)

Gap between the feed element 2 and the parasitic element 3: λ/230 (0.5 mm)

Gap between the antenna elements 2 and 3 and the slits 5 and 6: λ/230 (0.5 mm)

Width of the slits 5 and 6: λ/115 (1 mm)

Length of the slits 5 and 6: λ/7 (17 mm)

Distance from the slits 5 and 6 to the circuit region 4: λ/46 (2.5 mm)

Distance from the end of the feed element 2 to the circuit region 4: λ/230 (0.5 mm)

Distance form then end of the parasitic element 3 to the circuit region 4: λ/115 (1 mm)

In order to obtained the space diversity effect, the first and second antennas need to be arranged across a space more than λ/4 from each other. By forming the polarization direction of the first and second antennas being different from each other, the polarization diversity effect can be obtained.

It should be noted that when the first and second dipole antennas arranged on the both sides of the board 1 are used as diversity antennas, Dual-antenna coupling occurs. For that reason, when the antenna characteristics of one antenna are measured, the other antenna should be connected to a 50Ω reflection-free terminating resistor. As a result, the influence of the Dual-antenna coupling can be suppressed.

As explained above, the antenna of the radio apparatus of the present embodiment has the slits 5 and 6 between the antenna elements (the feed element 2 and the parasitic element 3) and the circuit region 4. In such a configuration, the capacity between the antenna elements 2 and 3 and the circuit region 4 becomes greater than that of the configuration in which no slit is provided. For that reason, the antenna characteristics are less subjected to the influence of the circuit region 4.

It should be noted that a low-permittivity material can be filled in the region where the slits 5 and 6 are provided. In such a case, although the low-permittivity material is not limited in particular, the following materials can be used. Note that the relative permittivity ∈r of these materials is approximately 2.1-2.7 at 1 kHz-1 MHz.

PTFE (polytetrafluoroethylene[4])

FEP (tetrafluoroethylene/hexafluoropropylene copolymer [4,6])

ETFE (tetrafluoroethylene/ethylene copolymer)

PFA (tetrafluoroethylene/perfluoroalkyl vinyl ether copolymer)

PCTFE (polychlorotrifluoroethylene[3])

In addition, PVDF (polyvinylidene-fluoride[2]) can be used as the low-permittivity material. However, the relative permittivity ∈r of PVDF is approximately 6.4-7.7 at 1 kHz-1 MHz. Accordingly, the use of PVDF is effective when narrowing the band.

Figure 10:
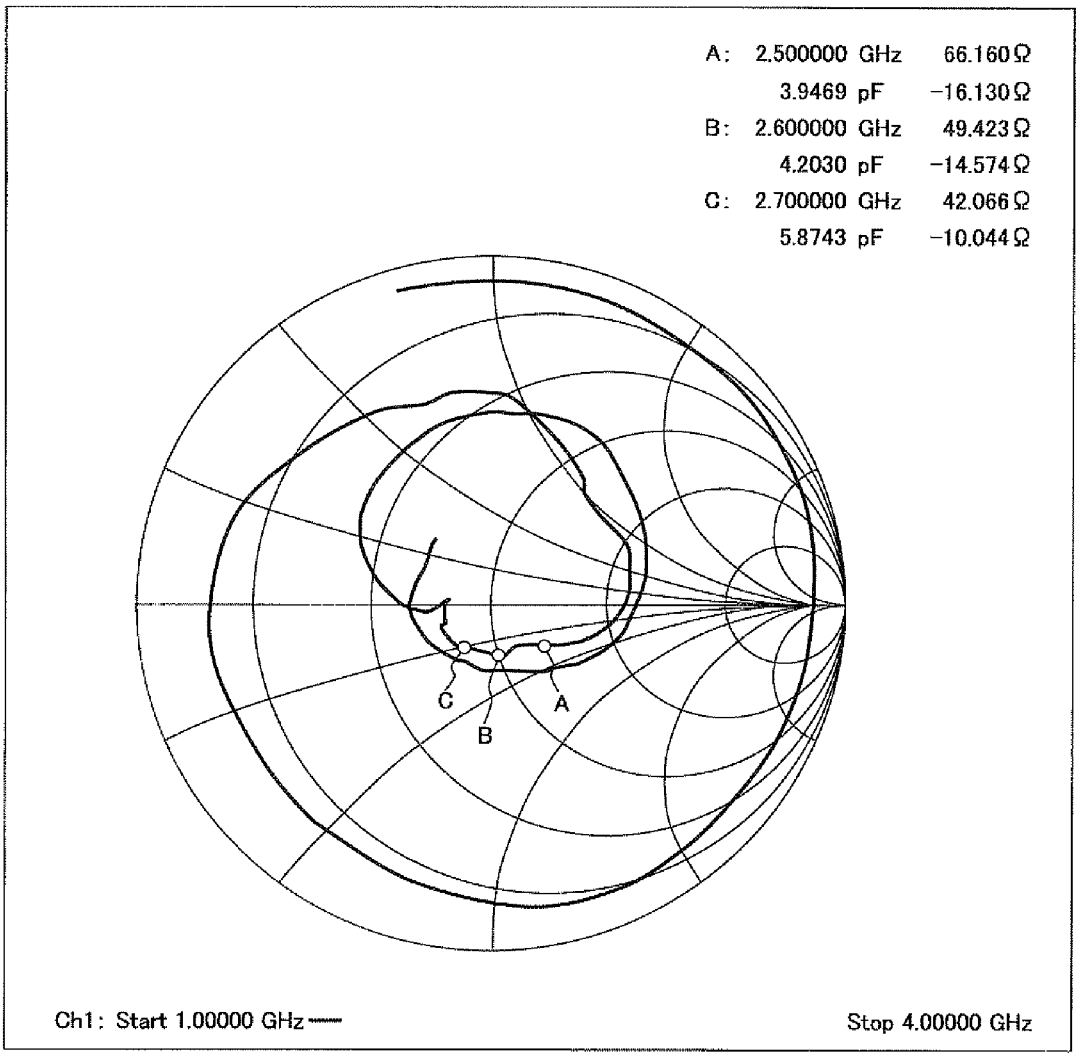
FIG. 10 is a smith chart with the antenna of the present embodiment.

Next, the technical advantage of forming the slits is explained with reference to FIGS. 10-13. FIG. 10 is a smith chart with the antenna of the present embodiment. Here, the characteristics of a 50Ω system are measured within 1 GHz-4 GHz. The points A, B, and C on the chart indicate the characteristics when the radio signal is 2.5 GHz, 2.6 GHz, and 2.7 GHz, respectively.

Figure 11:
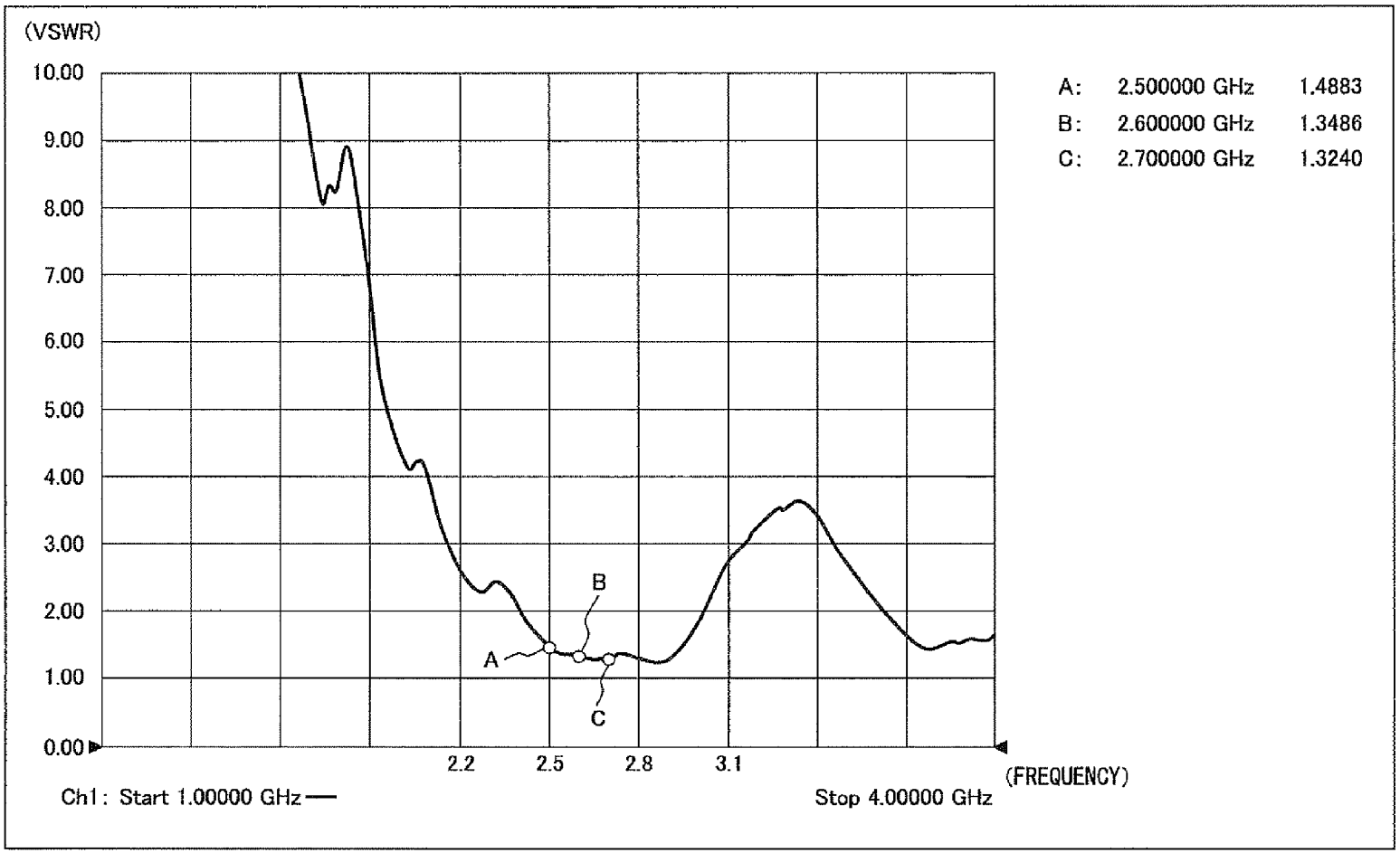
FIG. 11 is a diagram showing VSWR with the antenna of the present embodiment.

FIG. 11 is a diagram showing VSWR with the antenna of the present embodiment. Note that the VSWR in FIG. 11 corresponds to the smith chart of FIG. 10. In FIG. 11, the frequency is on the horizontal axis and the VSWR is on the vertical axis. The VSWR is an index for representing the reflected wave of the antenna. In other words, it is preferable that the antenna is used within the range where the VSWR has a small value. In this example, an antenna is used in a frequency band of "VSWR<2" (corresponding to "resonant frequency band").

When the antenna of the present embodiment is used, the frequency band of "VSWR<2" is within approximately 2.4-3.0 GHz. When calculated by the above equation (1), the bandwidth characteristic is approximately 22 percent.

Figure 12:
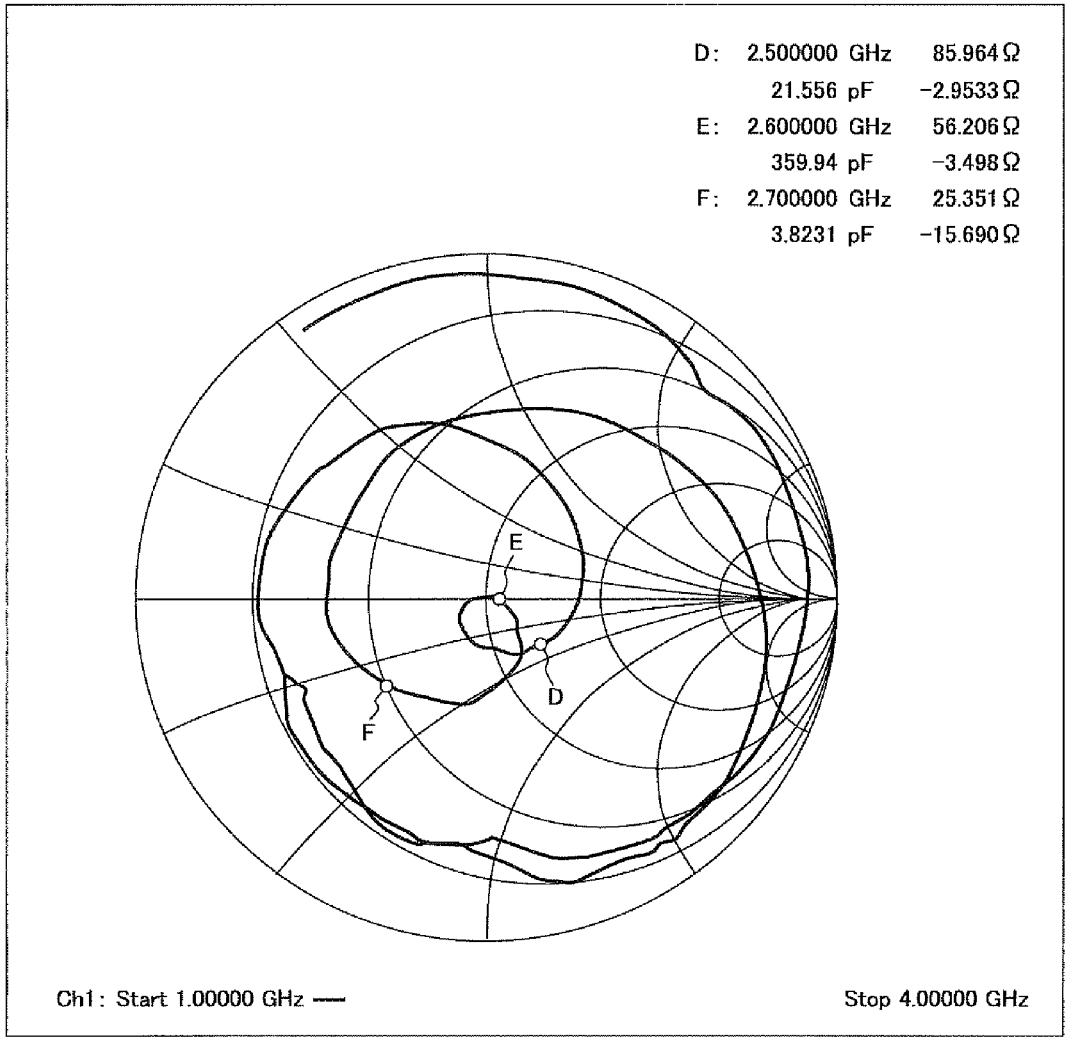
FIG. 12 is a smith chart of a case that a slit is not provided.

FIG. 12 is a smith chart of a case that the slit is not provided. The points D, E, and F on the chart indicate the characteristics when the radio signal is 2.5 GHz, 2.6 GHz, and 2.7 GHz, respectively. The characteristic points D-F vary more significantly than the characteristic points A-C shown in FIG. 10. In particular, the characteristic point F appears in a position distant from the center of the chart.

Figure 13:
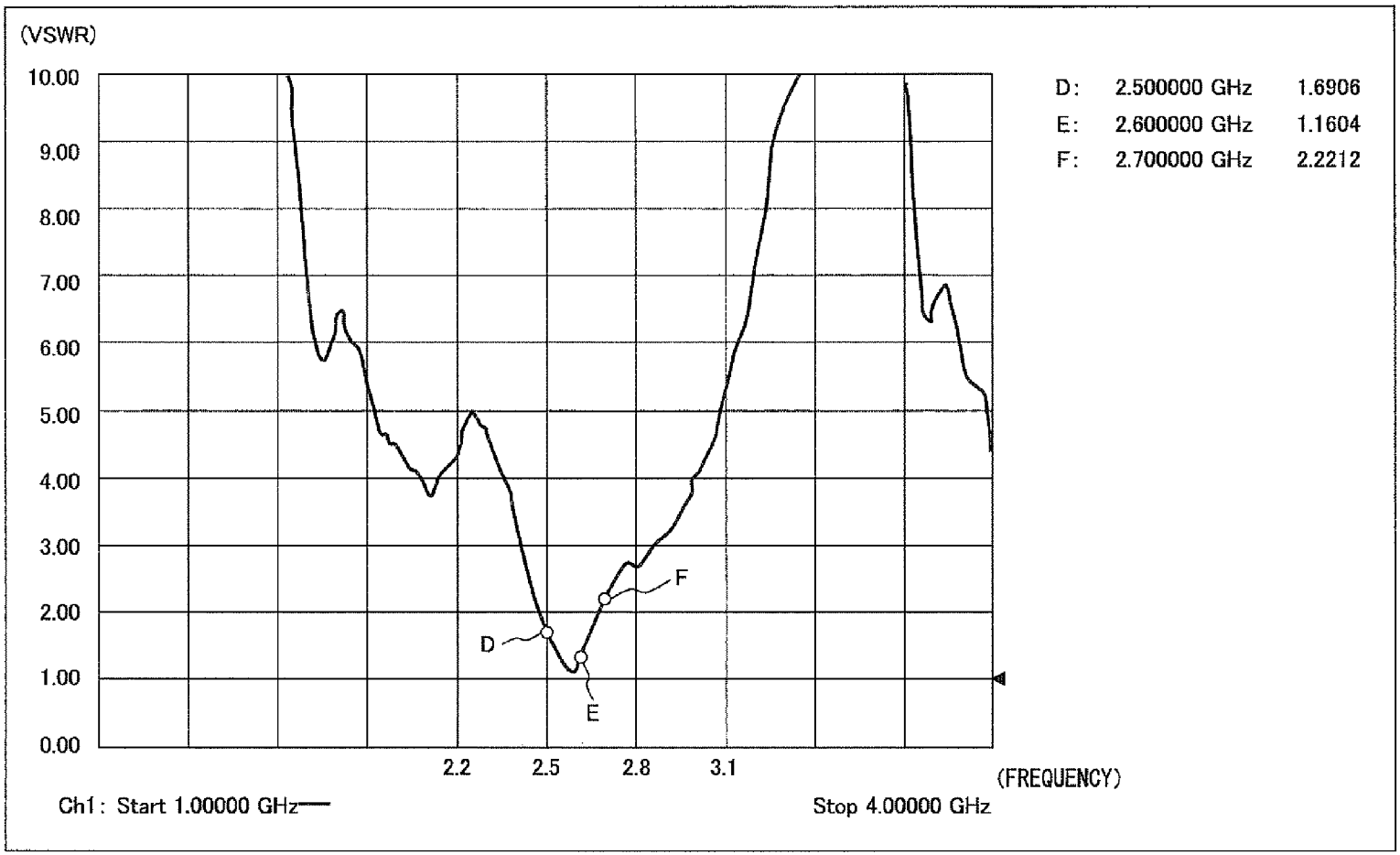
FIG. 13 is a diagram showing VSWR of a case that the slit is not provided.

FIG. 13 is a diagram showing VSWR of a case that the slit is not provided. Note that the VSWR shown in FIG. 13 corresponds to the smith chart of FIG. 12. As shown in FIG. 13, when the slit is not provided, the frequency band of "VSWR<2" is within approximately 2.45-2.65 GHz. When calculated by the above equation (1), the bandwidth characteristic is approximately only 8 percent.

As described above, the radio apparatus that employs the antenna of the present embodiment has wider resonant frequency band. For that reason, even if the resonant frequency band shifts due to changes in radio wave environment, radio signals can be transmitted/received in a preferable characteristic state. In other words, the antenna is less subjected to the influence of conductors (e.g. a metal table) that are present around the antenna. It is possible to reduce the thickness of the case for storing the antenna, and as a result, an antenna having a high degree of freedom for designing, less variations, and high accuracy can be created at a low price.

Figure 14:
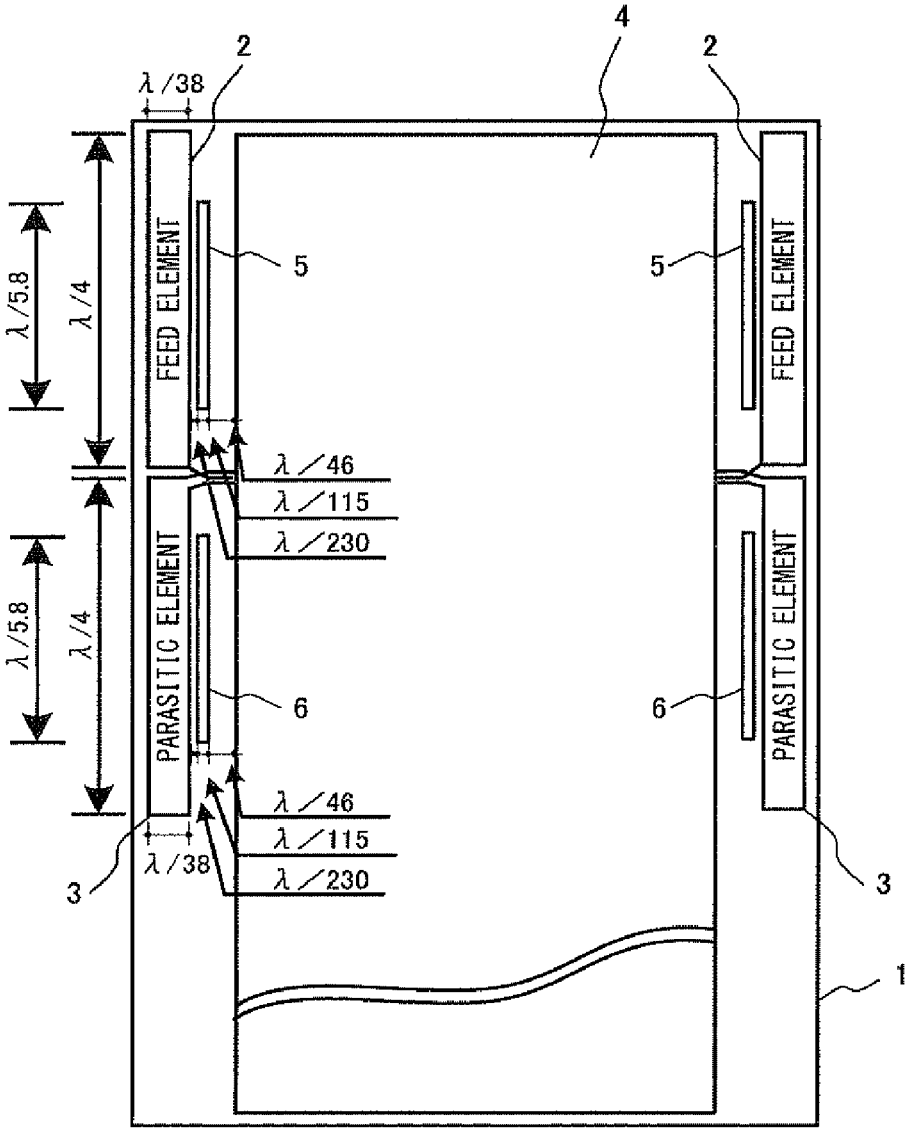
FIG. 14 is a diagram showing an arrangement of the antenna elements in another embodiment.

It should be noted that in the above example, the feed element 2 and the parasitic element 3 are arranged along with different sides of the board 1; however, the antenna of the embodiment is not limited to this configuration. As shown in FIG. 14, each pair of the feed element 2 and the parasitic element 3 can be arranged along with the same side of the board 1, for example. Note that in such a configuration, it is preferable that one of the each pair of the feed element 2 and the parasitic element 3 is formed on the surface layer and the other on the back layer.

Additionally, although the radio apparatus of the above embodiment comprises a dipole antenna, the embodiment is not limited to this configuration. In other words, the embodiment is applicable to an antenna with other forms (such as a bow-tie antenna).

Figure 15A:
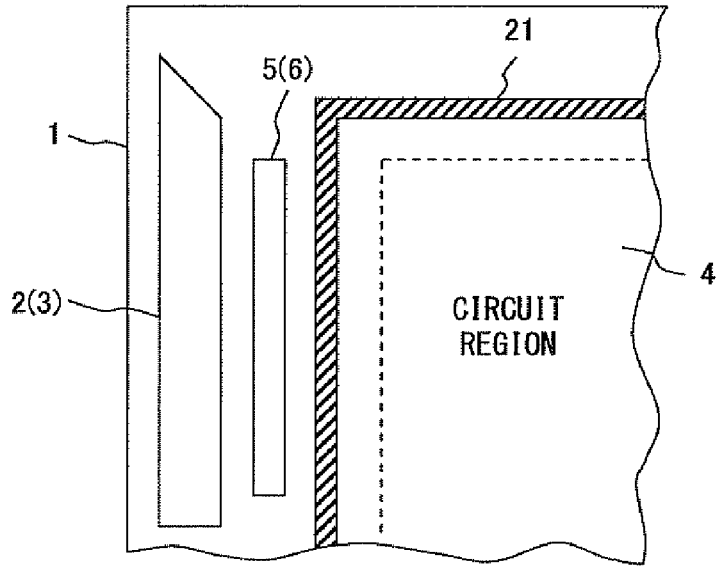
FIG. 15A and FIG. 15B are diagrams showing a configuration in which slits are provided between the antenna elements and a cover.
Figure 15B:
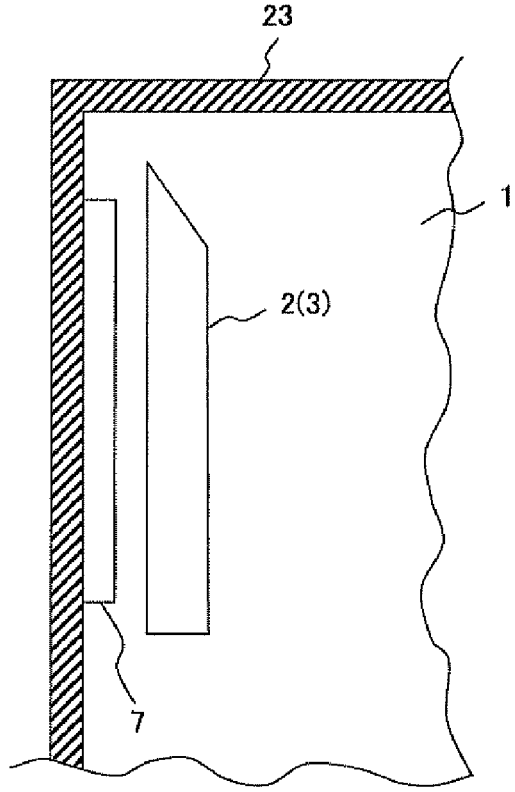

Furthermore, the above example shows a configuration in which slits 5 and 6 are provided between the antenna elements 2 and 3 and a circuit region 4; however, the embodiment is not limited to this configuration. In other words, the embodiment is applicable to configurations in which a low-permittivity region with the permittivity lower than the board 1 is provided between the antenna elements 2 and 3 and the metal member positioned proximity of the antenna elements. For example, when a shielding cover 21 for covering the circuit region 4 is provided on the board 1, a slit 5(6) can be provided in a region between the antenna element 2(3) and the shielding cover 21 as shown in FIG. 15A. When the board 1 is stored in the case (a metal cover) 23 shown in FIG. 8, as shown in FIG. 15B, a slit 7 can be provided in a region between the antenna elements 2 and 3 and the case 23. Note that in such a case, the slit 7 can be formed by cutting the end of the board 1.

As described above, one aspect of a radio apparatus is used for radio communication, and comprises an antenna, a circuit connected to the antenna, and a board on which the antenna and the circuit are mounted and in which the board is not present but a material having lower permittivity than the board is present in at least a portion between the antenna and the circuit.

In this configuration, a material having lower permittivity than the board is present between the antenna and the circuit. For that reason, the capacity between the antenna and the circuit becomes large, and the influence of the electromagnetic wave between the antenna and the circuit can be suppressed. Accordingly, the antenna is less subjected to the influence of the circuit, and the characteristics of the antenna are therefore improved.

Another aspect of a radio apparatus is used for radio communication, and comprises an antenna, a board on which the antenna is mounted, and a metal cover for covering at least a portion of the board. The board is not present but a material having lower permittivity than the board is present in at least a portion between the antenna and the cover.

In this configuration, a material having lower permittivity than the board is present between the antenna and the cover. For that reason, the capacity between the antenna and the cover becomes large, and the antenna is less subjected to the electromagnetic influence of the circuit. Consequently, the characteristics of the antenna can be improved.

According to these configurations, it is possible to provide a radio apparatus having an antenna with wide resonant frequency band.

The invention claimed is:

1. A radio apparatus used for radio communication, comprising:

an antenna;

a circuit connected to the antenna; and a board on which the antenna and the circuit are mounted, the board having a slit penetrating the board in a region between where the antenna and the circuit are mounted and the slit being filled by a material having lower permittivity than the board, wherein the antenna comprises a feed element formed on a first surface of the board and a parasitic element formed on a second surface of the board, and a signal line connected to the feed element and a GND line connected to the parasitic element are formed on different layer of the board so as to be close to each other to maintain certain impedance.

2. The radio apparatus according to claim 1, wherein the material having lower permittivity than the board is present in a slit formed on the board.

3. The radio apparatus according to claim 1, wherein the material having lower permittivity than the board is air that is present in the slit formed on the board.

4. The radio apparatus according to claim 1, wherein the material having lower permittivity than the board is PTFE, FEP, ETFE, PFA, PCTFE or PVDF.

5. The radio apparatus according to claim 1, wherein the antenna is fixed on the board at a null portion having no radiation.

6. A radio apparatus used for radio communication, comprising:

an antenna;

a board on which the antenna is mounted; and a metal cover for covering at least a portion of the board, wherein the board has a slit penetrating the board in a region between where the antenna and the circuit are mounted and the slit is filled by a material having lower permittivity than the board, the antenna comprises a feed element formed on a first surface of the board and a parasitic element formed on a second surface of the board, and a signal line connected to the feed element and a GND line connected to the parasitic element are formed on different layer of the board so as to be close to each other to maintain certain impedance.

7. An antenna provided on a board mounted with a circuit for radio communication, comprising:

a feed element formed on an end of the board; and a parasitic element formed on an end of the board, wherein the board has a slit penetrating the board in at least one of a region between where the feed element and the circuit are formed and a region between where the parasitic element and the circuit are formed and the slit is filled by a material having lower permittivity than the board, and a signal line connected to the feed element and a GND line connected to the parasitic element are formed on different layer of the board so as to be close to each other to maintain certain impedance.

8. The antenna according to claim 7, wherein the material is air.

9. The antenna according to claim 7, wherein lengths of the feed element and the parasitic element are different from each other.

* * * * *